United States Patent [19]

Colby

[11] 4,431,325

[45] Feb. 14, 1984

[54] REINFORCEMENT FOR CORNER MOUNTING HOLES

[76] Inventor: James Colby, 8 Eddy St., Sudbury, Mass. 01776

[21] Appl. No.: 352,039

[22] Filed: Feb. 24, 1982

[51] Int. Cl.[3] ..... B42F 13/00

[52] U.S. Cl. ..... 402/79

[58] Field of Search ..... 402/79

[56] References Cited

U.S. PATENT DOCUMENTS

| | | | |
|---|---|---|---|
| 860,645 | 7/1907 | Dobbins | 402/79 |
| 2,764,501 | 9/1956 | Derri | 402/79 |
| 3,315,683 | 4/1967 | Rodriguez et al. | 402/79 |
| 4,350,195 | 9/1982 | Viesturs | 402/79 |

FOREIGN PATENT DOCUMENTS

| | | | |
|---|---|---|---|
| 977350 | 11/1948 | France | 402/79 |
| 421804 | 12/1947 | Italy | 402/79 |
| 199985 | 7/1923 | United Kingdom | 402/79 |
| 397826 | 11/1931 | United Kingdom | 402/79 |

*Primary Examiner*—E. R. Kazenske
*Assistant Examiner*—Paul M. Heyrana
*Attorney, Agent, or Firm*—Irving M. Kriegsman

[57] ABSTRACT

A reinforcement for a corner mounting hole in a sheet of paper is disclosed. The reinforcement comprises a corner shaped pocket member made of paper or other similar material. The pocket includes a front wall and a back wall, each of which is coated on its inside surface with a layer of a moisture activated adhesive. Each wall further includes a hole which is located so as to be in registration with the corner mounting hole in the sheet of paper when the corner shaped pocket member is mounted onto the corner of the sheet. In using the reinforcement, the inside surfaces of the front and back walls are first moistened. The pocket is then slidably mounted onto the corner of the sheet of paper and then fixed in place with the holes in registration with the mounting hole to be reinforced. The reinforcement is especially useful in repairing or reinforcing the corner mounting holes in sheets of computer printout paper.

9 Claims, 4 Drawing Figures

REINFORCEMENT FOR CORNER MOUNTING HOLES

BACKGROUND OF THE INVENTION

The present invention relates in general to reinforcements for mounting holes on sheets of paper and more particularly to a reinforcement designed especially for use in reinforcing a mounting hole located at the corner of a sheet of computer printout or other type of paper.

Reinforcements for reinforcing and/or repairing mounting holes in sheets of paper are well known in the art and have been in use for over fifty years. Such items are generally in the form of a small annular or ringed shaped piece of paper or other similar material coated on one side with a layer of adhesive material, which is usually moisture activated.

In the past, these reinforcements have been used principally in connection with reinforcing and/or repairing any one of the two or more mounting holes located on the side edge of a sheet of "loose leaf" paper. With the advent of computers, the use of computer printout paper has become widespread and used as a recording medium for recording alpha/numeric information. As is known, computer printout paper generally contains a row of holes on each side of the sheet. It has become common practice, however, to mount the sheets on a folder or file using the hole at the top of each row (at each corner of the sheet) as the mounting holes so that the sheets hang vertically. Consequently, it is only the corner holes in such paper which may require reinforcement and which usually do after a period of time.

The need therefore exists for a reinforcement which is especially constructed for use in reinforcing corner mounting holes.

SUMMARY OF THE INVENTION

It is an object of this invention to provide a new and improved reinforcement for mounting holes in a sheet of paper.

It is another object of this invention to provide a new and improved reinforcement for a corner mounting hole in a sheet of paper.

It is still another object of this invention to provide a reinforcement for a corner mounting hole in a sheet of paper which is easy and economical to manufacture, which can be mass produced, which is easy to use and which is self-aligning with the mounting hole.

It is a further object of this invention to provide a hole reinforcement which is especially useful in repairing the upper corner mounting holes in a sheet of computer printout paper.

A reinforcement for a corner hole in a sheet of paper constructed according to the teachings of the present invention comprises a corner shaped pocket member made of paper or other similar material. The pocket includes a front wall and a back wall, each of which is coated on its inside surface with a layer of a moisture activated adhesive. Each wall further includes a hole which is located so as to be in registration with the corner mounting hole in the sheet of paper when the corner shaped pocket member is mounted onto the corner of the sheet. In using the reinforcement, the inside surfaces of the front and back walls are first moistened. The pocket is then slidably mounted onto the corner of the sheet of paper and then fixed in place with the holes in registration with the mounting hole to be reinforced. The reinforcement is especially useful in repairing or reinforcing the corner mounting holes in sheets of computer printout paper.

For a better understanding of the present invention, together with other aid further objects thereof, reference is made to the following description taken in conjunction with the accompanying drawings and its scope will be pointed out in the appended claims.

BRIEF DESCRIPTION OF THE DRAWINGS

In the drawings wherein like reference numerals represent like parts.

DETAILED DESCRIPTION OF PREFERRED EMBODIMENT

The present invention is directed to a reinforcement especially designed for use with a corner mounting hole in a sheet of paper.

Figure 1:
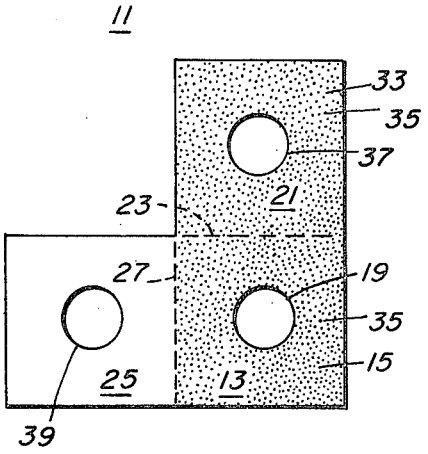
FIG. 1 is a plan view from the front of a reinforcement blank made according to the teachings of the present invention.
Figure 2:
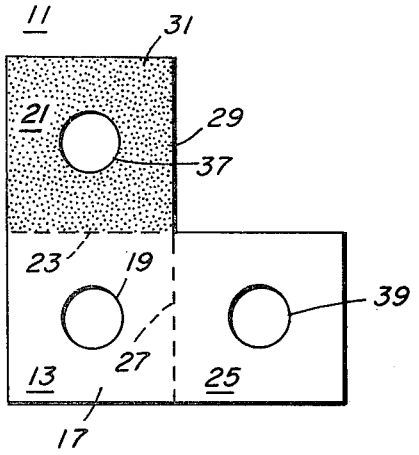
FIG. 2 is a plan view taken from the rear of the reinforcement blank shown in FIG. 1.

Referring now to FIGS. 1 and 2 there is illustrated a front and a rear view, respectively, of a reinforcement constructed according to the teachings of the invention, prior to assembly, the reinforcement being designated by reference numeral 11.

Reinforcement 11 which is made of a unitary blank of paper or other similar material is cut and scored to include a rectangularly shaped main panel 13 having a front surface 15, a rear surface 17 and a circular hole 19 which is at least as large as the corner mounting hole in the sheet of paper to be reinforced. Hole 19 is located on main panel 13 so as to be in registration with the corner mounting hole in the sheet of paper when the reinforcement is mounted in place on the sheet of paper adjacent the hole as will hereinafter be described.

Reinforcement 11 further includes a rectangularly shaped top panel 21 hingedly connected to main panel 13 about a fold line 23 which defines the upper edge of main panel 13 and the lower edge of top panel 21 and a rectangularly shaped side panel 25 which is hingedly connected to main panel 13 about a fold line 27 which defines a side edge of main panel 13 and a side edge of side panel 25. Top panel 21 includes a back surface 29 which is coated with a layer of glue 31. The front surface 15 of main panel 13 and the front surface 33 of top panel 21 are each coated with a layer of moisture activated adhesive 35. Top panel 21 and side panel 25 each have a circular hole 37, 39 respectively, which is at least of the same size as hole 19. The holes 37 and 39 are located on their respective panels so as to be in registration with hole 19 when the reinforcement is assembled as hereinafter described.

Figure 3:
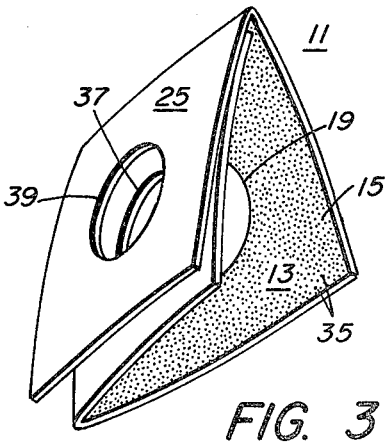
FIG. 3 is a perspective view of a fully assembled reinforcement made from the blank shown in FIG. 4.

Reinforcement 11 is assembled by folding top panel 21 forward over fold line 23, then folding side panel 25 over on fold line 27 in overlapping relationship on top panel 21 and then securing the side panel 25 in overlapping relationship on top panel 21 with the layer of glue 31. A fully assembled reinforcement ready for use is shown in FIG. 3.

Figure 4:
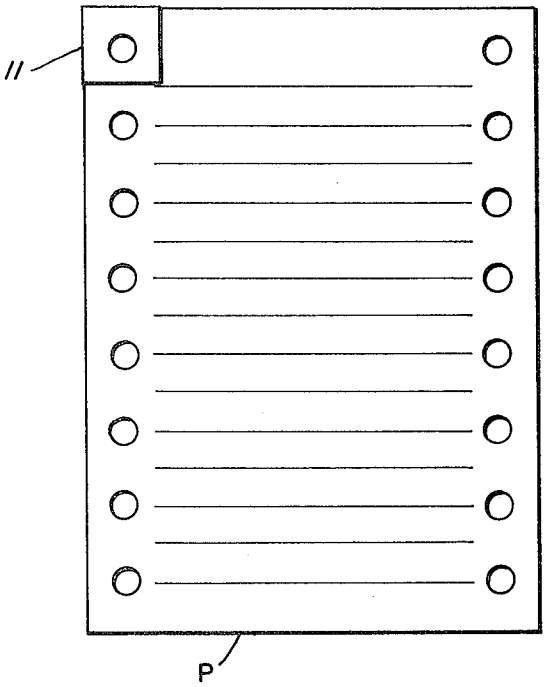
FIG. 4 is a plan view showing the reinforcement mounted in place on a sheet of paper.

The reinforcement 11 is used, by applying moisture to the moisture activated adhesive layer 35 on front surface 15 of main panel 13 and front surface 33 of top panel 21 and then slidably mounting the reinforcement 11 onto the corner of the sheet of paper P so that the holes align with the hole to be reinforced and securing the reinforcement 11 in place as shown in FIG. 4.

In another embodiment of the invention, fold line 27 is made perforated so that after the reinforcement is mounted on the sheet of paper, panel 13 may be separated from panel 25 to provide more flexibility of the sheet of paper over the reinforced area.

Although a particular embodiment of the invention has been described and illustrated herein, it is recognized that modifications and variations may readily occur to those skilled in the art and consequently, it is intended that the claims be interpreted to cover such modifications and equivalents.

What is claimed is:

1. A reinforcement for a corner mounting hole in a sheet of paper, said sheet of paper having a front surface and a back surface, the reinforcement comprising:

a. a main panel having a front surface, a back surface, a top edge, a side edge at right angles to said top edge and a hole, b. a top panel hingedly connected at a bottom edge to the top edge of the main panel, said top panel including a front surface, a back surface and a hole, c. a side panel hingedly connected at a side edge to the side edge of the main panel, said side panel including a front surface, a back surface and a hole, d. means for securing said back surface of said top panel to said front surface of said side panel in overlying relationship, said main panel, said top panel and said side panel defining a corner shaped pocket when said top panel is secured to said side panel with said holes in each panel being in registration with each other and, e. adhesive means inside said corner pocket for securing said reinforcement to the sheet of paper when said pocket is slid over the corner of said sheet of paper, said holes in said panels being in registration with the corner mounting hole in said paper when said reinforcement is mounted thereon.

2. The reinforcement of claim 1 and wherein said panels are made of a fibrous material.

3. The reinforcement of claim 2 and wherein said panels are made of paper.

4. The reinforcement of claim 3 and wherein said means for securing the back surface of the top panel to the front surface of the side panel is glue.

5. The reinforcement of claim 4 and wherein adhesive means is a moisture activated adhesive.

6. The reinforcement of claim 5 and wherein said holes are circular.

7. The reinforcement of claim 6 and wherein said panels are rectangularly shaped.

8. The reinforcement of claim 1 and wherein said adhesive means inside said corner pocket is on at least one inside surface of said corner pocket.

9. The reinforcement of claim 1 and wherein said adhesive means is on said front surface of said top panel and said back surface of said top panel.

* * * * *